US006243920B1

(12) United States Patent
Sauve

(10) Patent No.: US 6,243,920 B1
(45) Date of Patent: Jun. 12, 2001

(54) ROTATIONAL-TRANSLATIONAL DOUBLE HINGE-ARM

(75) Inventor: Raymond Sauve, Stone Mountain, GA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/337,600

(22) Filed: Jun. 21, 1999

(51) Int. Cl.[7] ..... E05D 15/22
(52) U.S. Cl. ..... 16/361; 16/357
(58) Field of Search ..... 16/357, 361, 366

(56) References Cited

U.S. PATENT DOCUMENTS

| | | | | |
|---|---|---|---|---|
| 472,622 | | 4/1892 | Linkletter . | |
| 1,920,568 | | 8/1933 | Kling . | |
| 3,251,089 | | 5/1966 | Fergison . | |
| 3,344,462 | * | 10/1967 | Webster | 16/357 |
| 4,712,828 | * | 12/1987 | Albrecht | 16/361 X |
| 4,839,941 | | 6/1989 | Orlando | 16/361 |
| 5,186,349 | | 2/1993 | Sakamoto | 16/361 X |
| 5,355,558 | | 10/1994 | Vertanen | 16/360 |

* cited by examiner

*Primary Examiner*—Anthony Knight
*Assistant Examiner*—Robert J. Sandy
(74) *Attorney, Agent, or Firm*—Pitney, Hardin, Kipp & Szuch, LLP

(57) ABSTRACT

The hinge includes a first flange and a second flange which pivot and translate with respect to each other. The first flange includes a first laterally offset pivot axis. The second flange includes a second laterally offset pivot axis and a translational path. Additionally, a pivot plate is provided with first and second parallel passageways. The first laterally offset pivot axis of the first flange engages the first parallel passageway of the pivot plate and the translational path of the second flange. The second laterally offset pivot axis of the second flange engages the second parallel passageway of the pivot plate. Initially relative pivoting of the first flange and the second flange causes the first laterally offset pivot axis of the first flange and the first parallel passageway of the pivot plate to translate within the translational path. Subsequent relative pivoting of the first flange and the second flange causes the pivoting about the first laterally offset pivot axis.

12 Claims, 5 Drawing Sheets

ROTATIONAL-TRANSLATIONAL DOUBLE HINGE-ARM

BACKGROUND OF THE INVENTION

1. Field of the Invention

This invention relates to a rotational-translational double hinge-arm that can be operated linearly and can have various drive systems.

2. Description of the Prior Art

In the prior art, hinges for double arm assemblies are known. However, these designs have frequently had a high torque required to break the joint between the two arms (frequently configured as an idler or non-driven arm and a torque or driven arm). Additionally, the smoothness of operation has been a substantial concern, particularly in consumer applications, such as freezers. Similarly, the sealing line, the hinge life and the panel weight distribution have all been a substantial design considerations in this field.

Examples of hinges in this field are disclosed in U.S. Pat. No. 5,355,558 entitled "Hinge Assembly", issued on Oct. 18, 1994 to Vertanen; U.S. Pat. No. 5,186,349 entitled "Hinge Mechanism", issued on Feb. 16, 1993 to Sakamoto; U.S. Pat. No. 4,839,941 entitled "Elevating and Traversing Hood Hinge", issued on Jun. 20, 1989 to Orlando; U.S. Pat. No. 3,251,089 entitled "Hinge Assembly", issued on May 17, 1966 to Fergison; U.S. Pat. No. 1,920,568 entitled "Cigar Box Hinge", issued on Aug. 1, 1933 to Kling; and U.S. Pat. No. 472,622 entitled "Hinge", issued on Apr. 12, 1892 to Linkletter.

OBJECTS AND SUMMARY OF THE INVENTION

It is therefore an object of this invention to provide a hinge for a double arm assembly with a low torque requirement to break the joint between the idler arm and the torque arm.

It is therefore a further object of this invention to provide a hinge for a double arm assembly which has smooth operation.

It is therefore a still further object of this invention to provide a hinge for a double arm assembly with an improved sealing line, particularly for use with a freezer, or similar applications.

It is therefore a still further object of this invention to provide a hinge for a double arm assembly which has an improved hinge life.

It is therefore a final object of this invention to provide a hinge for a double arm assembly which results in improved panel weight distribution.

These and other objects are attained by a hinge which includes a first flange affixed to a first arm and a second flange affixed to a second arm. The first flange includes a laterally offset first pivot axis formed by colinear offset apertures. The second flange includes a second pivot axis formed by colinear offset apertures and a translational path formed by offset slots. A first end of a pivot plate is pivotably attached to the first pivot point of the first flange and further travels within the translational path on the second flange. A second end of the pivot plate is pivotably attached to the second pivot axis.

The resulting rotational-translation double hinge-arm connecting a torque arm and an idler arm results in the center, in-line orientation of the arms of a bi-folding door, such as may be used for a freezer and many other applications. The double hinge allows for the low torque break of the joint between the arms. A drive system can be implemented with a round, grooved cam attached to a wire-rope cable.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
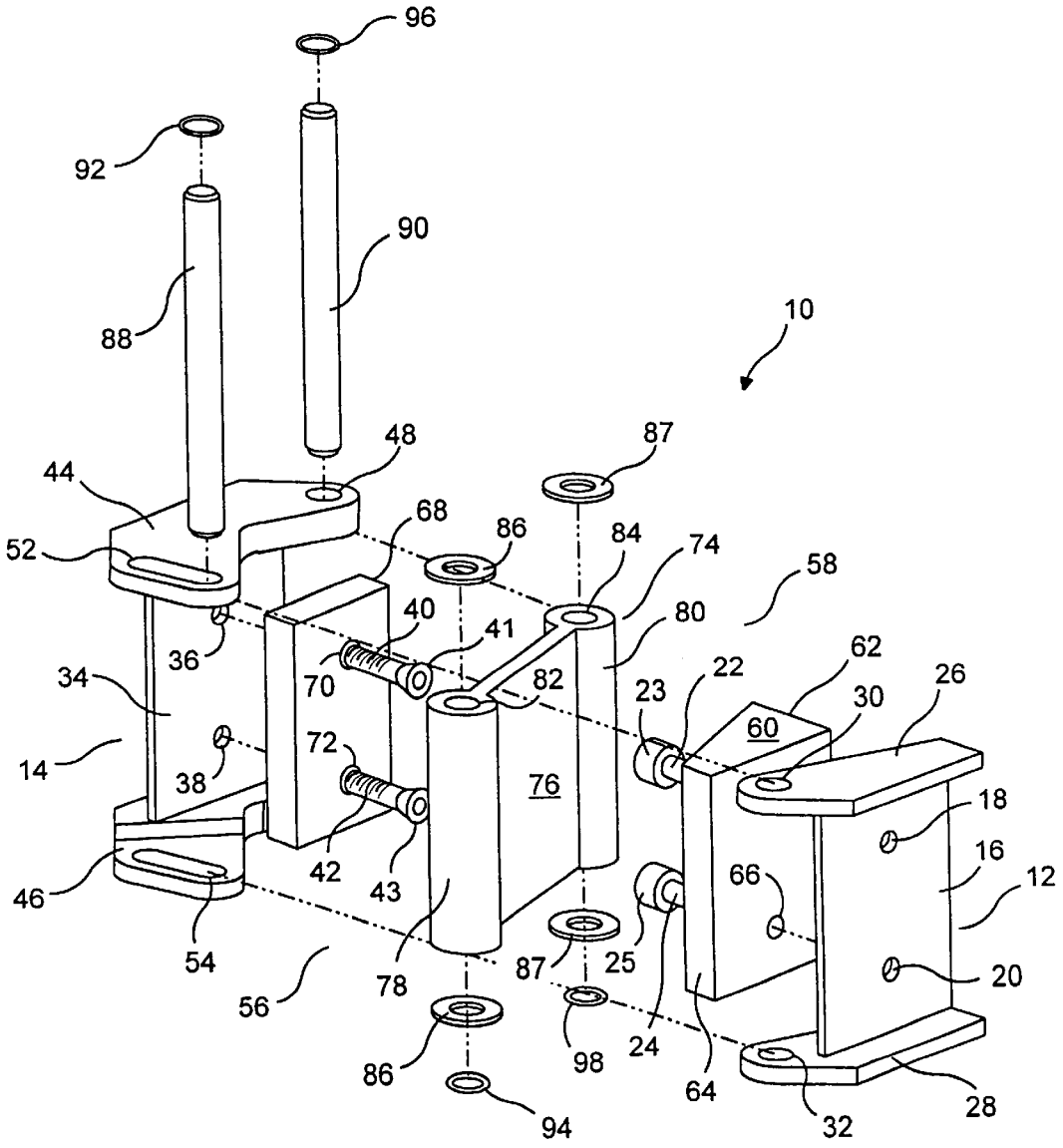
FIG. 1 is an exploded perspective view of the hinge assembly of the present invention.
Figure 2A:
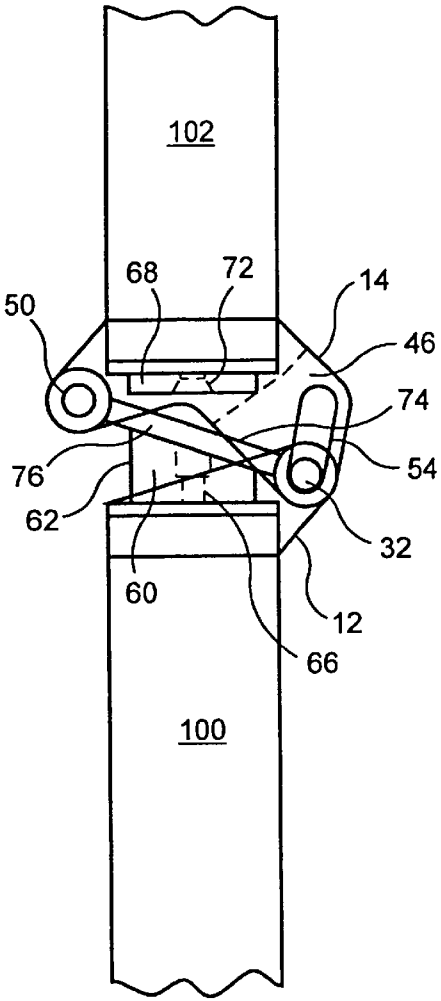
FIGS. 2*a,* 2*b* and 2*c* are plan views, partially in phantom, showing the sequence of the closed, partially open and open configurations of the hinge assembly of the present invention.
Figure 2B:
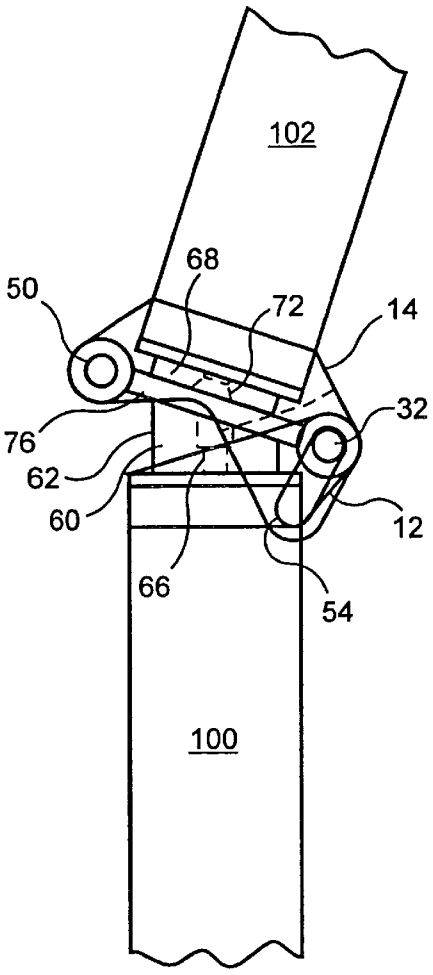
Figure 2C:
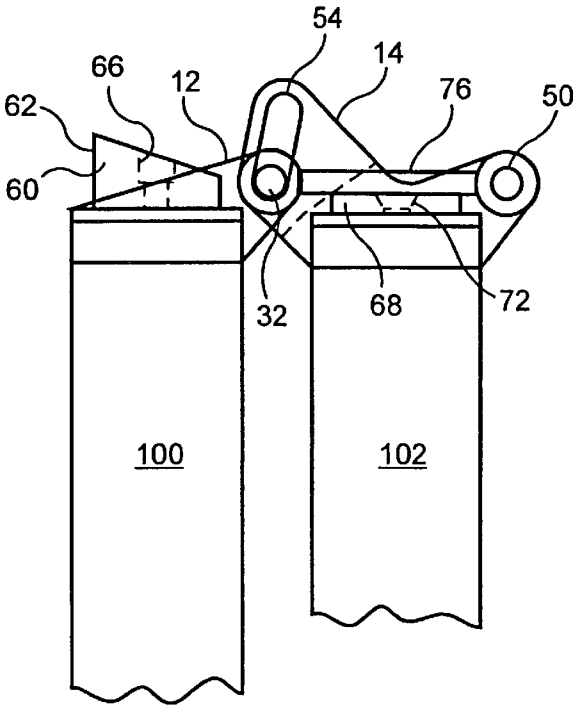
Figure 3:
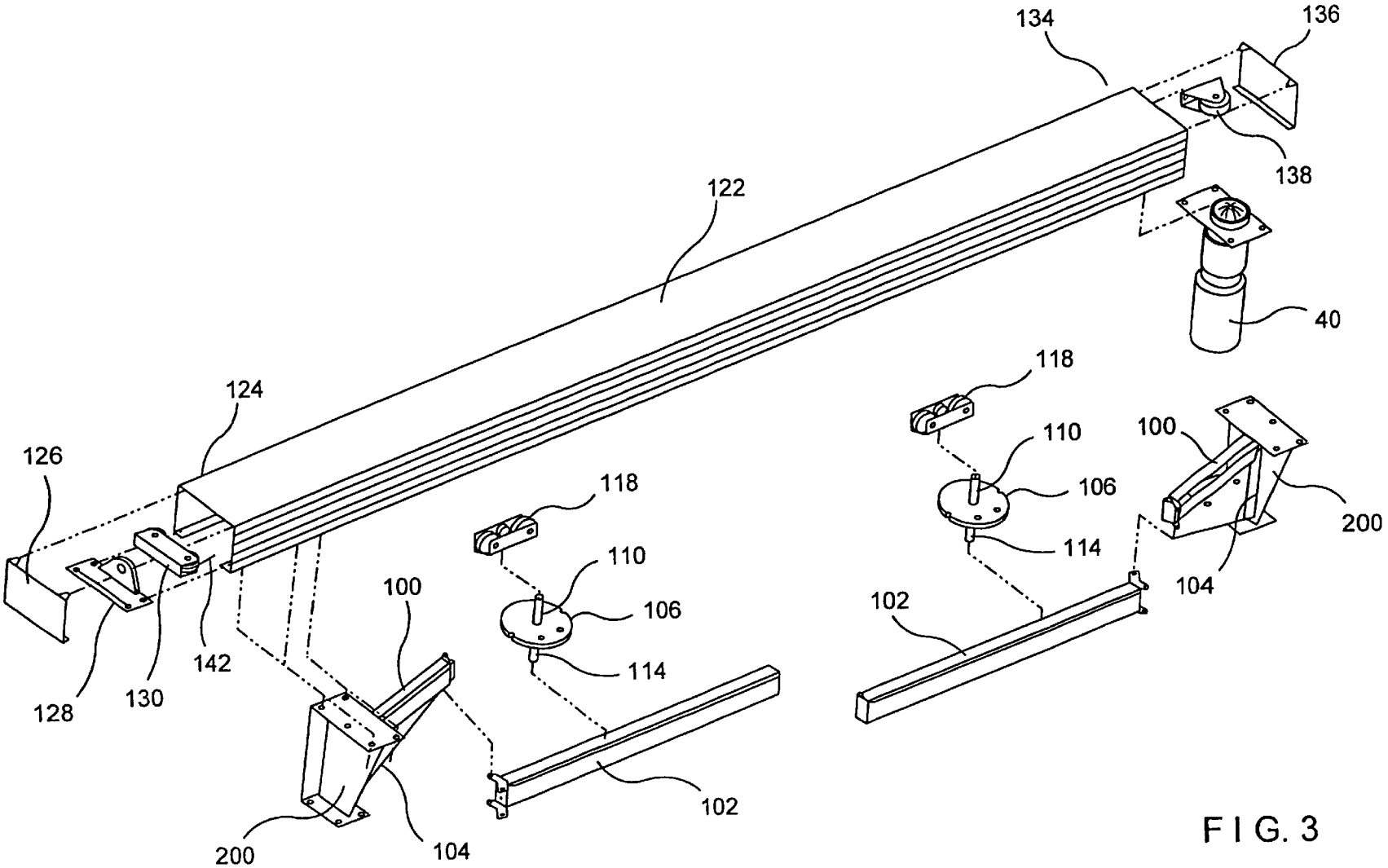
FIG. 3 is an exploded perspective view of a typical bi-folding door configuration using the hinge assembly of the present invention.
Figure 4:
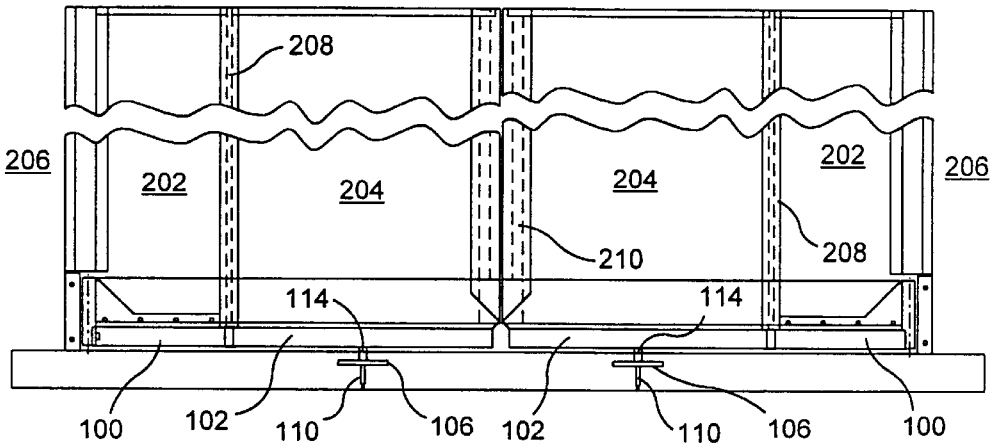
FIG. 4 is a top view of a typical bi-folding door configuration using the hinge assembly of the present invention.
Figure 5:
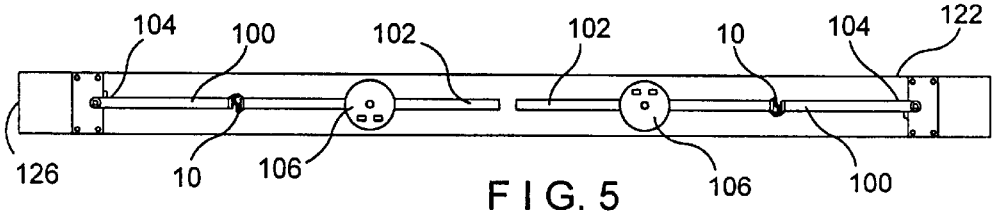
FIG. 5 is a side view of a typical bi-folding door configuration in the closed position using the hinge assembly of the present invention.
Figure 6:
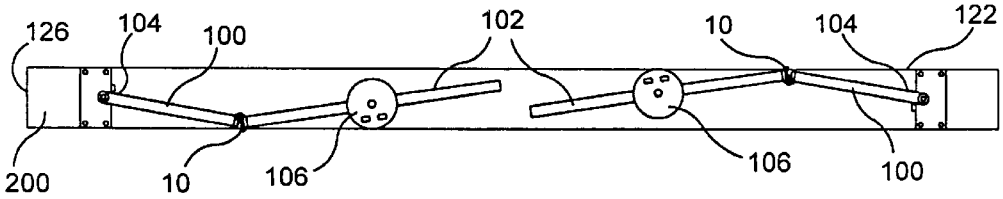
FIG. 6 is a side view of a typical bi-folding door configuration in the partially open position using the hinge assembly of the present invention.
Figure 7:
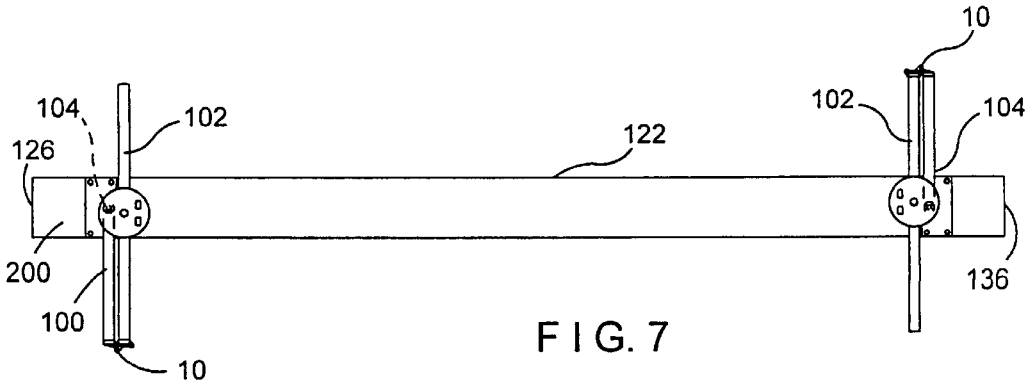
FIG. 7 is a side view of a typical bi-folding door configuration in the open position using the hinge assembly of the present invention.
Figure 8:
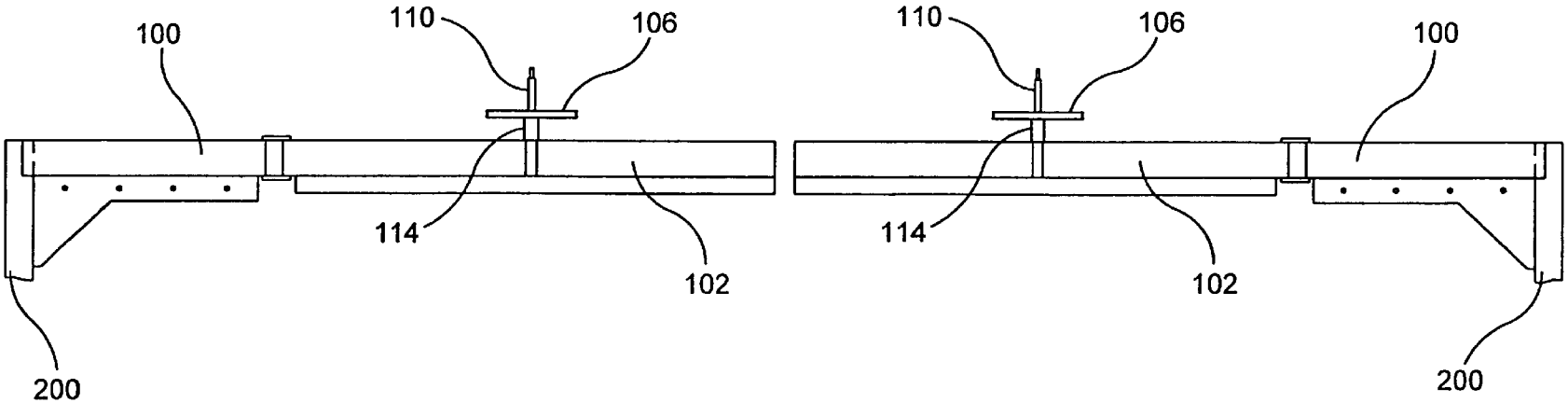
FIG. 8 is a top view of the arms in a typical bi-folding door configuration in the closed position using the hinge assembly of the present invention.

Referring now to the drawings in detail, wherein like numerals refer to like elements throughout the several views, one sees that FIG. 1 is an exploded perspective view of hinge 10. Hinge 10 includes first flange 12 in hinged relation with second flange 14. As shown in FIGS. 2*a*–2*c,* first flange 12 and second flange 14. are affixed to ends of first arm 100 and second arm 102, respectively.

First flange 12 includes central support plate 16 which further includes apertures 18, 20 for receiving bolts 22, 24 to secure first flange 12 to first arm 100. Central support plate 16 of first flange 12 further supports and separates pivot aperture support plates 26, 28 in a parallel relationship. Pivot aperture support plates 26, 28 include first laterally offset pivot point apertures 30, 32, respectively, in a colinear relationship thereby forming a first pivot axis which further serves as translational axis as will be described hereinafter.

Second flange 14 includes central support plate 34 which further includes apertures 36, 38 for receiving bolts 40, 42 to secure second flange 14 to second arm 102. Central support plate 34 of second flange 14 further supports and separates pivot aperture and slot support plates 44, 46 in a parallel relationship. Pivot aperture and slot support plates 44, 46 include second laterally offset pivot point apertures 48, 50, respectively, in a colinear relationship thereby forming a second pivot axis. Additionally, pivot aperture and slot support plates 44, 46 include laterally offset translational slots 52, 54, respectively, which are parallel to each other and formed along perpendicular projections of each other.

First laterally offset pivot point apertures 30, 32 and laterally offset translational slots 52, 54 are on a first lateral side 56 of hinge 10 while second laterally offset pivot apertures 48, 50 are on a second lateral side 58 of hinge 10.

Oblique block 60 includes relatively wider edge 62 on second lateral side 58 of hinge 10 and relatively narrower edge 64 on first lateral side 56 of hinge 10. Oblique block 60 further includes two apertures 66 (one aperture being unillustrated due to the perspective of FIG. 1) which align with apertures 18, 20 of first flange 12. As shown in FIGS. 2*a*–2*c*, aperture 66 is countersunk to receive head 25 of bolt 24. The unillustrated aperture is similarly countersunk to receive head 23 of bolt 22. Bolt 22 passes through the unillustrated aperture of oblique block 60 and aperture 18 of central support plate 16 of first flange 12 and into first arm 100. Likewise, bolt 24 passes through aperture 20 and aperture 66 thereby securing oblique block 60, first flange and first arm 100 together.

Orthogonal block 68 includes apertures 70, 72 which align with apertures 36, 38 of central support plate 34 of second flange 14. Bolts 40, 42 pass through apertures 70, 72 and 36, 38, respectively, and into second arm 102, thereby securing orthogonal block 68, second flange 14 and second arm 102 together. As shown in FIGS. 2*a*–2*c*, apertures 70, 72 are countersunk to receive conical heads 41, 43 of bolts 40, 42.

Pivot translational plate 74 is formed from central support plate 76 which separates two lateral parallel cylinders 78, 80 through which passageways 82, 84 are formed. Washers 86 are placed at the openings of passageway 82. Likewise, washers 87 are placed at the openings of passageway 84.

Rod 88 passes through laterally offset translational slots 52, 54 of second flange 14, first laterally offset pivot point apertures 30, 32 of first flange 12, passageway 82 of pivot translational plate 74, and washers 86. Rod 88 is secured against longitudinal movement at both ends by fasteners 92, 94. This configuration provides both a rotational and translational relationship between first flange 12 and second flange 14. Rod 90 passes through second laterally offset pivot apertures 48, 50 of second flange 14 and passageway 84 of pivot translational plate 74. Rod 90 is secured against longitudinal movement at both ends by fasteners 96, 98. This configuration provides a pivoting or rotational relationship between second flange 14 and pivot translational plate 74 in response to translational motion between first flange 12 and second flange 14.

FIGS. 2*a*–2*c* illustrate the opening sequence of first arm 100 and second arm 102. FIG. 2*a* illustrates the closed position wherein first arm 100 is aligned or colinear with second arm 102. Central support plate 76 of pivot. translational plate 74 abuts oblique block 60. First laterally offset pivot point apertures 30, 32 of first flange 12 along with lateral parallel cylinder 78 of pivot translational plate 74 have translated to the furthest extended portion of laterally offset translational slots 52, 54 of second flange 14.

FIG. 2*b* illustrates the position of hinge 10 in the partially open position. Second flange 14 and arm 102 have rotated relative to first flange 12 and arm 101 so that pivot translational plate 74 abuts both oblique block 60 and orthogonal block 68. First laterally offset pivot point apertures 30, 32 of first flange 12 along with lateral parallel cylinder 78 of pivot translational plate 74 have translated to the least extended portion of laterally offset translational slots 52, 54 of second flange 14.

FIG. 2*c* illustrates the position of hinge 10 in the fully open position. Second flange 14 has rotated relative to first flange 12 about a pivot point established in FIG. 2*b*. That is, first laterally offset pivot point apertures 30, 32 of first flange 12 along with lateral parallel cylinder 78 of pivot translational plate 74 remain translated to the least extended portion of laterally offset translational slots 52, 54 of second flange 14. Second arm 102 has now rotated 180° relative to first arm 100.

FIGS. 3–8 illustrate hinges 10 as implemented in bi-folding door configuration. First arms 100 are configured as non-driven or idler arms with ends 104 pivotably attached to stationary brackets 200. Second arms 102 are configured as driven or torque arms and, as previously described, are pivotally and translationally attached to first arms 100 by hinges 10. First arms 100 form the edge of panels 202 which are hinged to wall 206 colinearly with the pivotably relationship between ends 104 and stationary brackets 200. Second arms 102 form the edge of panels 204. The intersection of panels 202 and panels 204 is covered with PVC panels 208 to provide a temperature barrier in such applications as freezers. Similar PVC barriers 210 are provided at the inwardly facing edges of panels 204. Those skilled in the art will realize that other barriers can be used for different applications. Round grooved cams 106 provide the driving mechanism to second arms 102. Cams 106 include upper central pins 110 which rotatably engage roller carriages 118 and lower pins 114 which are affixed to second arms 102. Roller carriages 118 travel within track 122.

First end 124 of track 122 is terminated by endcap 126. Idler roller support 128 is affixed inwardly adjacent from endcap 126. Idler roller 130 is affixed upwardly adjacent from roller support 128. Second end 134 of track is terminated by endcap 136. Driven roller 138 is inwardly adjacent from endcap 136 and is driven by electric drive 140. Looped drive chain 142 loops around idler roller 130 and driven roller 138. The two roller carriages 118 are attached to opposite legs of looped drive chain 142 so that roller carriages 118 travel in the opposite direction of each other in order to effect the sequence shown in FIGS. 5, 6 and 7.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A hinge for rotationally and translationally joining a first arm to a second arm, the hinge comprising:

a first flange to be affixed to the first arm, said first flange including a first laterally offset pivot axis on a first side of the hinge;

a second flange to be affixed to the second arm, said second flange including a second offset pivot axis on a second side of the hinge and a translational path on said first side of the hinge;

a pivoting plate with a first end pivotally attached to said first laterally offset pivot axis and traveling within said translational path, and a second end pivotally attached to said second laterally offset pivot axis; and wherein said translational path comprises a pair of offset grooves.

2. A hinge for rotationally and translationally joining a first arm to a second arm, the hinge comprising:

a first flange to be affixed to the first arm, said first flange including a first laterally offset pivot axis on a first side of the hinge;

a second flange to be affixed to the second arm, said second flange including a second offset pivot axis on a second side of the hinge and a translational path on said first side of the hinge;

a pivoting plate with a first end pivotally attached to said first laterally offset pivot axis and traveling within said translational path, and a second end pivotally attached to said second laterally offset pivot axis; and wherein said first laterally offset pivot axis comprises a first pair of offset colinear apertures for receiving a first rod.

3. The hinge of claim 2 wherein said second laterally offset pivot axis comprises a second pair of offset colinear apertures for receiving a second rod.

4. The hinge of claim 3 wherein said translational path comprises a pair of offset grooves.

5. The hinge of claim 4 wherein said first flange comprises a first central plate separating a first pair of parallel plates, said first pair of offset colinear apertures being formed on respective parallel plates of said first pair.

6. The hinge of claim 5 wherein said second flange comprises a second central plate separating a second pair of parallel plates, said second pair of offset colinear apertures being formed on respective parallel plates of said first pair, and said pair of offset grooves being formed on respective parallel plates of said second pair.

7. The hinge of claim 6 wherein said pivoting plate includes a first passageway and a second passageway, said first passageway and said second passageway being parallel to each other and being formed along said first laterally offset pivot axis and said second laterally offset pivot axis, respectively, said first passageway receiving said first rod, and said second passageway receiving said second rod.

8. The hinge of claim 7 wherein said first laterally offset pivot axis is at a first end of said translational path when the hinge is in a closed position, and said first laterally offset pivot axis translates to a second end of said translational path as the hinge moves from said closed position to a partially open position, and wherein said second flange rotates about said first laterally offset pivot axis at said second end of said translational path as the hinge moves from said partially open position to a fully open position.

9. The hinge of claim 8 further including an oblique block with a relatively narrower end on said first side of the hinge and a relatively wider end on said second side of the hinge, said oblique block abutting said first central plate.

10. The hinge of claim 9 wherein said pivoting plate abuts an oblique face of said oblique block when the hinge is in said open position.

11. The hinge of claim 10 further including a relatively orthogonal block abutting said second central plate.

12. The hinge of claim 11 wherein said pivoting plate abuts said relatively orthogonal block when the hinge is in said partially open position.

* * * * *